US005193779A

United States Patent [19]

Frey et al.

[11] Patent Number: 5,193,779

[45] Date of Patent: Mar. 16, 1993

[54] ACTUATING DRIVE

[75] Inventors: Heinz Frey, Menziken; Kamil Prochazka, Windisch, both of Switzerland

[73] Assignee: Asea Brown Boveri Ltd., Baden, Switzerland

[21] Appl. No.: 586,227

[22] Filed: Sep. 21, 1990

[30] Foreign Application Priority Data

Sep. 28, 1989 [CH] Switzerland ..... 3518/89

[51] Int. Cl.[5] ..... F16K 31/02; F16K 31/122

[52] U.S. Cl. ..... 251/29; 91/361; 91/459; 251/30.01

[58] Field of Search ..... 91/361, 388, 459, 461; 251/25, 26, 28, 29, 30.01, 57, 63.5, 63.6, 279, 58; 318/604, 607

[56] References Cited

U.S. PATENT DOCUMENTS

| | | | |
|---|---|---|---|
| 3,948,478 | 4/1976 | Vind | 251/29 |
| 4,106,390 | 8/1978 | Kodaira et al. | 91/361 |
| 4,215,844 | 8/1980 | Bowen | 251/28 |
| 4,311,296 | 1/1982 | Scheffel | 251/30.03 |
| 4,335,867 | 6/1982 | Bihlmaier | 251/28 |
| 4,589,444 | 5/1986 | Masek et al. | 251/25 |
| 4,595,979 | 6/1986 | Arai et al. | 91/361 |
| 4,637,587 | 1/1987 | Kuhnlein | 251/29 |
| 4,807,518 | 2/1989 | Berchtold et al. | 91/361 |
| 4,901,625 | 2/1990 | Bussan | 91/361 |
| 4,932,311 | 6/1990 | Mibu et al. | 91/361 |

FOREIGN PATENT DOCUMENTS

| | | |
|---|---|---|
| 0127027 | 5/1984 | European Pat. Off. . |
| 474923 | 4/1929 | Fed. Rep. of Germany . |
| 3309441 | 9/1984 | Fed. Rep. of Germany . |
| 2748611 | 4/1989 | Fed. Rep. of Germany . |
| 244150 | 8/1946 | Switzerland . |
| 473318 | 7/1969 | Switzerland . |

*Primary Examiner*—George L. Walton

*Attorney, Agent, or Firm*—Burns, Doane, Swecker & Mathis

[57] ABSTRACT

This actuating drive (1) has a main piston (4) which can be operated by means of an oil pressure and a pilot control system in effective connection to the main piston (4) by means of a linkage (15). The pilot control system includes a control orifice (14) controlling the oil pressure at the main piston (4) and a pilot control piston arrangement (18) which can be operated hydraulically.

The actuating drive (1) is to be designed in such a way that it has improved dynamic characteristics during operation. This is achieved by the fact that the pilot control piston arrangement (18) can be operated by means of an electrohydraulic valve which is triggered by an electronic control unit (31).

7 Claims, 1 Drawing Sheet

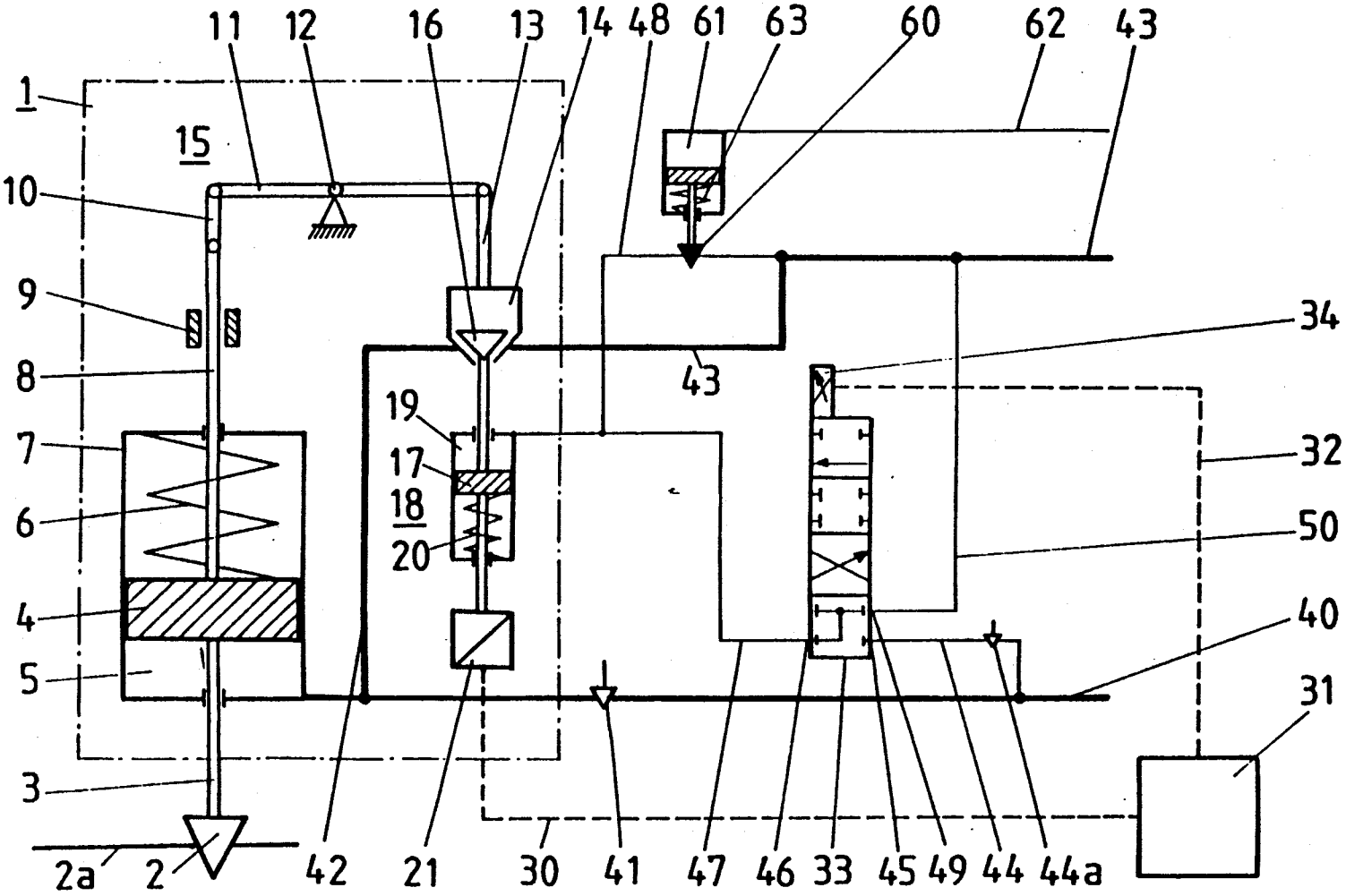
34
32
50
40
31
43
62
60
63
61
48
14
13
16
12
11
15
1
10
9
8
7
6
4
5
3
2a
2
42
21
30
41
47
46
33
45
49
44
44a
43
19
17
18
20

ACTUATING DRIVE

BACKGROUND OF THE INVENTION

1. Field of the Invention

The invention is based on an actuating drive for a control valve having a main piston which can be operated by oil pressure and having a pilot control system in effective connection with the main piston by means of a linkage, which pilot control system has at least one control orifice controlling the oil pressure at the main piston and at least one pilot piston arrangement which can be hydraulically operated.

2. Discussion of Background

An actuating drive for operating a control valve by which, for example, the steam supplied to a turbine is controlled, has a main piston which is subjected at one end to spring force and at the other end to oil pressure. When the oil pressure drops, the spring force reliably closes the control valve, which therefore cuts off the steam supply in every case. This ensures that the turbine cannot reach any uncontrollable operating condition if the oil pressure for the control valve should fail. In this design, an actuating signal is generated as an oil pressure by a central electrohydraulic converter which simultaneously operates a plurality of actuating drives. This involves comparatively long signal pipelines for the oil transmitting the actuating signal so that the necessary pipework volume has a negative effect on the dynamic behavior of the actuating drive.

The main piston of the actuating drive is connected via a linkage to a control orifice which interacts with a pilot piston arrangement and controls the flow of oil to the main piston. If a particular stroke characteristic of the actuating drive is desired, this can only be achieved by means of a complicated device—such as slotted links or cam discs with corresponding mechanisms—integrated in the linkage. The stroke of the actuating drive is generally monitored in operation and in this case, the monitoring is only possible by means of a relatively complicated measurement device. An additional disadvantageous effect is that the actuating drive function cannot, in this case, be made safe directly by means of a hydraulic oil safety circuit.

SUMMARY OF THE INVENTION

Accordingly, one object of this invention, as characterized in the claims, is to provide a control valve actuating drive which has improved dynamic characteristics in operation.

The advantages achieved by the invention may be seen essentially in the fact that any changes occurring in the control characteristic can be implemented rapidly and without changes to mechanical parts. In addition, signal pipelines are no longer necessary so that, on the one hand, the pipework volumes adversely affecting the dynamic characteristics are reduced to a minimum in the hydraulic system and, on the other, the construction of the system is greatly simplified. The stroke of the actuating drive can be separately monitored without problems so that, particularly during a starting-up phase, advantageously reduced operational periods can be achieved. The safety of the actuating drive is increased because this design can be operated by means of a hydraulic oil safety circuit.

The further embodiments of the invention are the subject matter of the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein the single figure shows a diagrammatic representation of an actuating drive in accordance with the invention.

DESCRIPTION OF THE PREFERRED EMBODIMENTS

Referring now to the single figure, this shows an actuating drive 1 which actuates a control valve 2, which can open and close a diagrammatically represented superheated steam pipe 2a. The control valve 2 is connected to a main piston 4 by means of a rod 3. A driving volume 5 subjected to oil pressure is here located underneath the main piston 4. A spring 6 acting against the oil pressure is provided above the main piston 4. A diagrammatically indicated main cylinder 7 encloses the spring 6, the main piston 4 and the driving volume 5. A further rod 8 is connected to the main piston 4 at the spring 6 end. Like the rod 3, this rod 8 penetrates the main cylinder 7. The detailed design of these pressure-tight penetrations are not described here. The rod 8 is guided by a guide 9 and it has a hinge connection to a link 11 via a hinged intermediate piece 10. The link 11 is rotatably supported in a fixed bearing location 12, which is indicated. The other end of the link 11 has a hinge connection with a rod 13 which interacts with a control orifice 14. The rod 13 is provided, in the upper region, with a part (not shown) which facilitates the conversion of the rotary motion of the link 11 into a straight-line motion of the rods 13 and 8, in a similar manner to the intermediate piece 10 between the rod 8 and the link 11. The sub-assembly consisting of the rod 8, the intermediate piece 10, the link 11, the bearing location 12 and the rod 13 is referred to as the linkage 15. In this linkage 15, shown greatly simplified, non-linear elements such as cam discs or slotted link controls can also be provided.

The control orifice 14 has a diagrammatically indicated closure piece 16 which is rigidly connected to a piston 17 of a pilot piston arrangement 18. The pilot piston arrangement 18 has an operating volume 19, subject to oil pressure, above the piston 17 and a spring 20, provided below the piston 17 and acting on the latter. The position of the piston 17 is monitored by means of a displacement measurement device 21 rigidly connected to the piston 17. As indicated by an effect line 30 (shown dashed), electrical signals, proportional to displacement and emitted by the displacement measurement device 21, are fed into an electronic control unit 31. As indicated by a dashed effect line 32, the control unit 31 is also in effective connection with a proportional directional control valve 33. This effective connection includes, on the one hand, the electromagnetic operation (controlled by the electronic control unit 31 according to certain specified criteria) of the proportional directional control valve 33 and, on the other hand, the electrical signals, fed back into the control unit 31 and proportional to the displacement, of a displacement measurement device 34, which monitors the position of the proportional directional control valve 33. A defined initial position of the proportional directional control valve 33 is achieved by means of a spring (not shown). The proportional directional control valve 33 also has an additional stroke feedback (not shown) which, together with an electronic position control (not shown either) achieves proportional control behavior of this proportional directional control valve 33 and, by this means, sets an oil flow quantity proportional to an electrical signal acting on the system.

Oil is fed in under pressure through a pipe 40 and the necessary oil pressure is generated by a pump which is not shown. The quantity of oil flowing is controlled by an orifice 41 located along the course of the pipe 40. The orifice 41 can either have an opening with constant cross-section or an opening with a controllable cross-section. The oil flows into the driving volume 5 and continues from there, as indicated diagrammatically by the branch pipe 42, to the control orifice 14 and on through the latter into a pipe 43 which leads to a drain arrangement (not shown). From this drain arrangement, the oil passes on through the pump mentioned back into the pipe 40. Branching off from the pipe 40, there is a pipe 44 with an orifice 44*a*, which leads to an inlet 45 of the proportional directional control valve 33. One outlet 46 of the proportional directional control valve 33 is connected to the actuating volume 19 of the pilot control valve arrangement 18 by means of a pipe 47. Branching off from this pipe 47, there is a pipe 48 which enters the pipe 43. A pipe 50, which also enters the pipe 43, leads away from a further outlet 49 of the proportional directional control valve 33.

The proportional directional control valve 33 is advantageously located in the immediate vicinity of the pilot control piston arrangement 18 or is flanged onto the latter to form a monolithic sub-assembly so that the pipe 47, and hence the pipe volume to be filled with oil, is small. The dynamic characteristics of the control are greatly improved by the absence of the signal lines. All the pipes which are subject to oil pressure are designed with the smallest possible longitudinal extension in order to reduce pipework volumes and hence improve the dynamic characteristics of the actuating drive.

A safety valve 60, which has an actuating volume 61 and is here designed as a plate valve, is inserted in the pipe 48. The safety valve 60 is generally closed because the operating volume 61 is subjected so strongly to the pressure of the hydraulic safety oil from a hydraulic oil safety circuit (not shown) through a pipe 62 that a spring 63 acting in the opening direction of the safety valve cannot expand. The pipe 48 is also designed to be as short as possible.

For the explanation of the mode of operation of the actuating drive 1, the figure should be considered in more detail. The proportional directional control valve 33 is connected in such a way that oil from the operating volume 19 of the pilot piston arrangement 18 can flow through the pipes 47 and 50 into the pipe 43 and through the latter into the drain arrangement. The result of this is that the spring 20 can press the piston 17, and with it the closure piece 16 of the control orifice 14, upwards so that the flow cross-section of the control orifice 14 is increased. The orifice 41 limits the flow quantity of the oil but because more oil can now flow through the control orifice 14, the oil pressure in the driving volume 5 decreases and the spring 6 presses the main piston 4 downwards so that the control valve 2 is moved in the closing direction. This process continues until the electronic control unit 31 determines, on the basis of the arriving signals proportional to displacement from the displacement measurement device 21, that the required position of the control valve 2 has been reached. Compensation is provided in the control unit 31 for any non-linearities in the closing behavior of the control valve 2. During the commissioning of this actuating drive 1, these non-linearities are input into the control unit 31 and any fine adjustments necessary can also be carried out by means of an input into the control unit 31. One and the same type of control unit can therefore be used for a wide variety of control valves because only appropriate programming is necessary in order to adapt the control unit. In addition, any given closing and opening characteristics of the control valve 2 can be set by using the control unit 31. In this way, complicated mechanical changes to the linkage 15, which would otherwise be necessary to change the driving characteristics of the actuating drive 1, can be avoided.

If the control valve 2 is now to be re-opened, so that more steam can pass through the superheated steam pipe 2*a* into a turbine, the proportional directional control valve 33 is switched over by means of an instruction from the control unit 31 to be precise in such a way that the switch diagram shown at the top of this valve applies. In this case, the inlet 45 is connected through to the outlet 46 so that oil, whose quantity is controlled by the proportional directional control valve 33, can flow through the pipes 44 and 47 into the operating volume 19 of the pilot control piston arrangement 18 and increase the oil pressure there because no oil flows away through the pipe 48. The opening rate of the pilot control piston arrangement 18 is limited by the orifice 44*a*. The pilot piston arrangement 18 closes or reduces the flow cross-section of the control orifice 14 so that the oil pressure in the driving volume 5, fed by the pipe 40, increases so that the main piston 4 is moved upwards and, at the same time, the control valve 2 is moved in the opening direction. As soon as the specified required value is reached, the control unit 31 recognizes this fact and controls the proportional directional control valve 33 downwards so that no additional oil reaches the operating volume 19.

The functioning of the control valve 2 must be inspected at periodic intervals in order to ensure that in the case of a fault, it can always carry out its closing motion. In the case of conventional actuating drives, an additional oil pressure pipe must be run for this purpose into the pilot control piston arrangement 18 so that the latter can be operated against the pressure present in the operating volume 19. In this case, the piston 17 was then moved upwards, the control orifice 14 was opened, the pressure could escape from the driving volume 5 via the control orifice 14 and the control valve 2 executed a closing motion independent of the rest of the control system. This additional oil pressure pipe had to be equipped with the valves and be safely shut off from the rest of the control system in order to avoid undesirable and dangerous operations of the pilot control piston arrangement 18. This complicated solution now becomes unnecessary because this control can be initiated directly by means of the control unit 31 by appropriate electrical triggering of the proportional directional control valve 33.

The safety requirements applied to technical installations, and also particularly to thermal power stations, continually increase. A comparatively high level of safety is achieved if a separate hydraulic oil safety circuit permits all the valves relevant to safety to be operated almost simultaneously. The safety valve 60 opens immediately when the pressure of the hydraulic safety oil drops in the pipe 62. The oil from the operating volume 19 of the pilot piston control arrangement 18 flows very rapidly away through the pipe 48 and the actuating drive 1 immediately closes the control valve 2. This closing occurs even if there is an electricity failure because the springs 63, 20 and 6 ensure safe achievement of the switch-off position even without additional energy. A safe final condition of the actuating drive 1 is always achieved in this way and unstable operating conditions cannot occur.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. A drive for actuating a control valve comprising:

a hydraulic main piston rigidly connected to a control valve by a rod member;

pilot control means for adjusting a hydraulic pressure provided to an actuating chamber of said main piston and to thereby adjust said control valve;

said pilot control means including a control orifice in communication with said actuating chamber of said main piston;

said pilot control means including hydraulic piston means for varying the side of said control orifice and thereby adjust said hydraulic pressure in said actuating chamber of said main piston;

said pilot control means including an electrohydraulic valve in communication with said hydraulic piston means for controlling a position of said hydraulic piston means and thereby controlling said size of said control orifice in response to a control means;

said pilot control means including rod linkage connecting said main piston to said control orifice wherein said orifice size is varied according to movement of said main piston and said control orifice;

a first displacement measurement device disposed on said hydraulic piston for generating an electronic signal representative of a position of said hydraulic piston;

a second displacement measurement device disposed on said electrohydraulic valve for generating an electronic signal representative of a position of said electrohydraulic valve; and, having a comparison means for comparing said electronic signals from said first and second displacement measurement devices to desired values and for changing a position of said electrohydraulic valve when said signals deviate from said desired values, and to thereby control the position of said main piston, said hydraulic means and said control orifice for controlling the size of said control orifice for adjusting said control view.

2. A drive for actuating a control valve as set forth in claim 1, wherein said electrohydraulic valve is a proportional directional control valve.

3. A drive for actuating a control valve as set forth in claim 2, wherein said proportional directional control valve is connected to said hydraulic piston means to form a monolithic unit.

4. A drive for actuating a control valve as set forth in claim 1, wherein said rod linkage includes non-linear elements for compensating non-linear actuating characteristics of said control valve.

5. A drive for actuating a control valve as set forth in claim 1, wherein said electronic control means includes means for compensating non-linear actuating characteristics of said control valve.

6. A drive for actuating a control valve as set forth in claim 4, wherein said electronic control means, includes means for compensating non-linear actuating characteristics of said control valve along with said non-linear elements of said rod linkage.

7. A drive for actuating a control valve as set forth in claim 1, including a safety valve for closing said control valve in the event of system anomaly.

* * * * *